US005217136A

United States Patent [19]

Sanden, Jr.

[11] Patent Number: 5,217,136

[45] Date of Patent: Jun. 8, 1993

[54] REFUSE CONTAINER

[75] Inventor: Gorden J. Sanden, Jr., Huntington Beach, Calif.

[73] Assignee: Roto Industries, Inc., Anaheim Hills, Calif.

[21] Appl. No.: 765,049

[22] Filed: Sep. 24, 1991

[51] Int. Cl.[5] ..... B65D 90/00

[52] U.S. Cl. ..... 220/337; 220/908; 220/334

[58] Field of Search ..... 220/334, 337, 343, 908

[56] References Cited

U.S. PATENT DOCUMENTS

| | | | |
|---|---|---|---|
| 806,885 | 12/1905 | Focht . | |
| 1,461,175 | 7/1923 | Bicker . | |
| 1,815,101 | 7/1931 | Goldstein . | |
| 2,021,425 | 11/1935 | Nielsen . | |
| 2,740,632 | 4/1956 | Balmer . | |
| 3,085,323 | 4/1963 | Handley . | |
| 3,224,076 | 12/1965 | Johnson, Jr. et al. . | |
| 3,292,252 | 12/1966 | Reading . | |
| 3,306,486 | 2/1967 | Martino et al. . | |
| 3,354,529 | 11/1967 | James . | |
| 3,889,805 | 6/1975 | Korten . | |
| 3,942,678 | 3/1976 | Kaydemann . | |
| 4,113,398 | 9/1978 | Jordan . | |
| 4,158,424 | 6/1979 | Carmack . | |
| 4,164,675 | 8/1979 | Sato et al. . | |
| 4,186,844 | 2/1980 | Swanson . | |
| 4,257,527 | 3/1981 | Snyder et al. . | |
| 4,342,402 | 8/1982 | Jungles . | |
| 4,401,312 | 8/1983 | Parker . | |
| 4,450,976 | 5/1984 | Snyder et al. . | |
| 4,558,799 | 12/1985 | Hammond . | |
| 4,749,101 | 6/1988 | Durkan, Jr. | 220/908 X |
| 4,836,394 | 6/1989 | Glomski | 220/334 X |
| 4,847,028 | 7/1989 | Snyder et al. . | |
| 5,071,024 | 12/1991 | Delmerico et al. | 220/908 X |
| 5,141,124 | 8/1992 | Smith et al. | 220/908 X |

FOREIGN PATENT DOCUMENTS

| | | |
|---|---|---|
| 1081143 | 7/1980 | Canada . |
| 1111360 | 10/1981 | Canada . |
| 56037 | 4/1986 | Canada . |
| 56621 | 7/1986 | Canada . |
| 1210343 | 8/1986 | Canada . |
| 57111 | 9/1986 | Canada . |
| 58625 | 11/1986 | Canada . |
| 62192 | 11/1988 | Canada . |
| 266899 | 10/1912 | Fed. Rep. of Germany . |
| 1996887 | 2/1968 | Fed. Rep. of Germany . |
| 2614535 | 4/1976 | Fed. Rep. of Germany . |
| 2633553 | 7/1976 | Fed. Rep. of Germany . |
| 7712227 | 4/1977 | Fed. Rep. of Germany . |
| 2717258 | 7/1977 | Fed. Rep. of Germany . |
| 7714149 | 9/1977 | Fed. Rep. of Germany . |
| 31935 | 5/1978 | Fed. Rep. of Germany . |
| 2844474 | 10/1978 | Fed. Rep. of Germany . |
| 8111786 | 4/1981 | Fed. Rep. of Germany . |
| 10296 | of 1905 | United Kingdom . |
| 363492 | 1/1932 | United Kingdom . |
| 1513122 | 3/1977 | United Kingdom . |

OTHER PUBLICATIONS

Kirk Manufacturing, Inc. advertisement, Mar. 1990.

Refuse Container Design discussed in Information Disclosure Statement of Mar. 16, 1992.

*Primary Examiner*—Steven M. Pollard

*Attorney, Agent, or Firm*—Knobbe, Martens, Olson & Bear

[57] ABSTRACT

A refuse container having a hinge assembly with a split hinge pin. The two portions of the hinge pin being separable for insertion into an aperture of a hinge knuckle and biased together to maintain the hinge pin in the knuckle when the hinge is assembled. The lid of the refuse container carries the integrally molded hinge pin, supported between a pair of support arms, with a division area that allows the pin to be pulled apart for assembly. The container body is integrally molded with the hinge knuckle which receives the hinge pin through the aperture to rotatably couple the lid and the container body together. No other components are needed to secure the lid with the container body.

22 Claims, 9 Drawing Sheets

REFUSE CONTAINER

BACKGROUND OF THE INVENTION

1. Field of the Invention

The present invention relates generally to refuse containers, and more particularly to molded, refuse containers featuring a hinge assembly formed between integral components of a container body and a lid, enabling a hinged connection devoid of bolts, pins or fasteners.

2. Description of Related Art

Refuse containers are typically used for the curbside collection of rubbish from personal residences and small businesses. In many municipalities today, automated equipment, such as side-loading refuse trucks having a retractable lifting clamp, handle refuse containers by grasping, lifting and inverting the container to empty its contents.

Such refuse containers conventionally include hinged lids to reduce odors permeating from the refuse container and to the shield the refuse in the container from the elements, e.g., rain and/or wind. In addition, such containers additionally include some type of wheeled support and maneuvering handle to afford easy portability of the container, especially when filled with refuse. The manufacture of conventional containers having hinged lids, wheels and handles, however, requires extensive post-molding assembly procedures, such as, for example, drilling additional holes, mounting additional hardware, and assembling together a multitude of parts.

In an attempt to reduce the complexity of the assembly process and simplify the design of such containers, others have conceived of somewhat simpler designs. For example, U.S. Pat. No. 4,450,976 to Snyder discloses a portable molded container including a container body and a lid having transversely spaced hinge means with transversely aligned holes. A hinge rod passes through the holes to provide a pivot and to serve as the container handle; the hinge means are spaced apart to allow the rod to be exposed in two sections along its length. Press-on cap nuts secure the rod in place through the hinge means. Although the container design disclosed in the Snyder patent reduces the number of parts forming a hinge/handle assembly between the refuse container and lid, the design still requires five separate parts to construct the hinge/handle assembly.

The number of parts needed to assemble the prior refuse containers creates a number of problems. First, during the manufacturing process more effort is necessary to dimension, layout and fabricate the extra holes, pins and fasteners. Second, shipping the additional parts adds expense and increases the possibility of omitting small parts. Third, the greater the number of parts, the more difficult it becomes to maintain a sufficient stock of components to prevent a stoppage of production. Production ceases if one component is out of stock. Fourth, the assembly is complicated due to the necessity of aligning and joining together the multitude of components, thus increasing production time and labor costs. In addition, there is a greater likelihood of tolerance mismatch between a large number of components, further frustrating the assembly process. Smaller parts can also get lost during the assembly. Finally, the fastening mechanism of the aforementioned prior are typically of metal construction prone to corrosion.

SUMMARY OF THE INVENTION

In a preferred embodiment of the present invention, a container features a hinge assembly formed between a container body and a lid to rotatably couple the two components together. The lid includes a hinge pin or axle integrally formed with the lid which inserts into a bushing integrally formed with the container body, to form the hinge assembly. No other components are required to join the lid and the container.

Broadly defined, the hinge assembly of the present invention includes a first hinge member with two hinge pin portions biased together at a division area and a second hinge member having an aperture adapted to receive the hinge pin. The hinge pin portions are separable to enable insertion through the bushing. Once inserted, the ends of the hinge pin portions are biased together in a juxtaposed position. A portion of the hinge pin is preferably exposed to function as a handle.

In a preferred embodiment of the present invention, the container comprises a container body having a bushing, and a lid. The lid covers at least a portion of the container body and includes an axle extending between a pair of support arms with a "bologna" cut severing the axle. The axle is sized to be inserted into the bushing to rotatably couple the lid with the body. The axle preferably slip fits into the bushing to a position where the bologna cut lies within the bushing with the lid coupled with the container body. To ease assembly and strengthen the junction, the bologna cut is positioned oblique to the longitudinal axis of the axle, and more preferably cants towards the center of the lid at a 45° angle.

Preferably, the container body includes a bottom and an upstanding sidewall extending from the circumference of the bottom to define an interior cavity. The sidewall terminates at an upper edge to define an opening into the cavity. The container body additionally includes a first lug, being positioned adjacent to the upper edge and cantilevering from the sidewall away form the interior cavity. The first lug supports the bushing.

The lid preferably includes a center support arm positioned between the pair of support arms to generally support a mid-section of the axle. A second bologna cut is positioned along the axle on a side of the center support arm opposite from the first bologna cut. The body container also comprises a second lug projecting from the sidewall in a direction generally parallel to the first lug and having a second bushing adapted to receive a portion of the axle.

The bottom, the sidewall and the lugs preferably comprise a one piece integrally molded structure, and the cover, the support arms and the axle likewise comprise a one piece integrally molded structure, formed of a resilient flexible material. Preferably, the container body and the lid are rotationally molded of cross-linked polyethylene.

In accordance with another aspect of the present invention, a method of coupling a lid to a container body devoid of fasteners is defined. The method includes the steps of integrally molding a lug onto a sidewall of the container body, with the lug having an axle bushing. An axle is positioned to extend between a pair of support arms on the lid. The axle is then severed at a position between the support arms to form a division area, and separated at the division area to form a gap between two portions of the axle. The first portion of the axle is inserted through the bushing to rotatably couple the axle with the lug. Finally the second portion of the axle is juxtaposed with the first portion of the axle and inserted through the bushing. Preferably, the method additionally includes the step of positioning the division area in the bushing to secure the lid with the container. The method also includes the step of exposing a portion of the axle between the supporting arms so that it can be grasped and function as a handle for maneuvering the container.

BRIEF DESCRIPTION OF THE DRAWINGS

These and other features of the invention will now be described with reference to drawings of preferred embodiments which are intended to illustrate, and not to limit, the invention, and in which.

DETAILED DESCRIPTION OF THE PREFERRED EMBODIMENT

Figure 1:
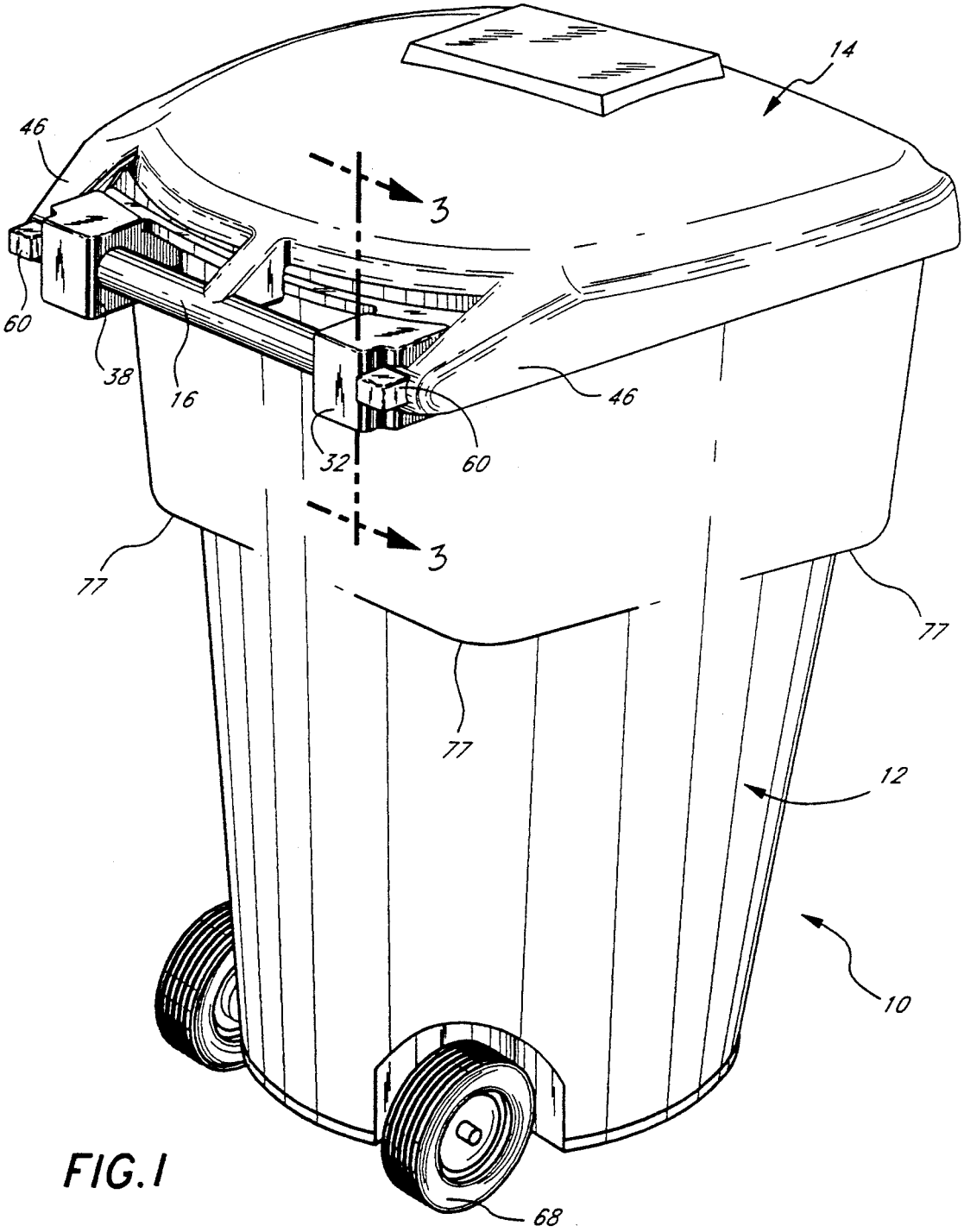
FIG. 1 is a perspective view of a refuse container in accordance with an embodiment of the present invention.
Figure 2:
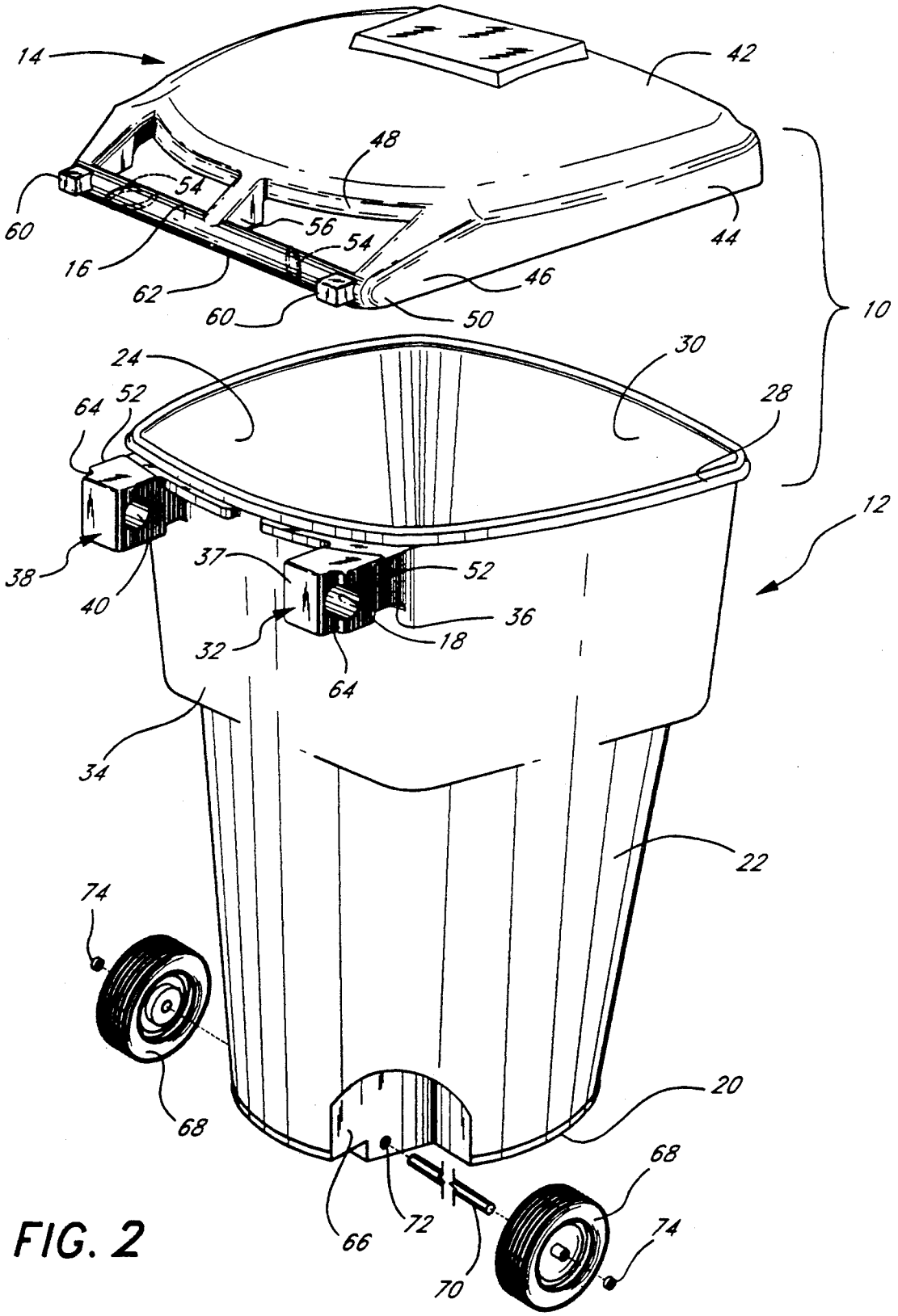
FIG. 2 illustrates an exploded perspective view of the refuse container of FIG. 1.

FIGS. 1 through 5 illustrate one preferred embodiment of a refuse container 10 typically used for the collection of rubbish from residences and small businesses. The refuse container 10 features a hinge assembly formed between a container body 12 and a lid 14 to rotatably couple the lid 14 to the container body 12. As shown in FIG. 2, the lid 14 includes a hinge pin or axle 16 which is inserted into an axle bushing 18 integrally formed with the container body 12, to form the hinge assembly. No other components, such as, for example, hinge rods, caps, pins or fasteners, are required to join the lid 14 to the container body 12. Consequently, the integral hinge assembly design simplifies assembly, reduces assembly cost and time, and improves reliability due to the reduced number of parts and the absence of small breakable parts. The only "after molding" steps are to cut the hinge pin in the appropriate places, attach the lid to the body and assemble the wheels with the container body.

The body 14 and the lid 12 are preferably rotatably molded of a hardened plastic, such as, for example, a low density linear polyethylene or a cross-linked polyethylene, available commercially as PAXON from Allied Signal or as MARLEX from Phillips Chemical. Those skilled in the art, however, will appreciate that the present refuse container can also be constructed by blow-molding or by injection molding. Preferably, the container body 12 and the lid 14 have a generally uniform wall thickness less than a ½ inch and more preferably equal to about an ⅛ inch. The individual components of the refuse container 10 will now be discussed in detail.

Referring to FIG. 2, the container body 12 has a generally cylindrical shape and comprises a bottom 20 and an upstanding sidewall 22 extending from the periphery of the bottom 20 to form an interior cavity 24. Preferably, the interior cavity 24 has a volume of about 60 or 100 gallons. It is understood, however, that the volume of the interior cavity 29 can be of any size.

At a top end 26 of the refuse container 10, the sidewall 22 terminates in a collar 28 defining an opening 30 which opens into the hollow interior cavity 24 of the container body 12. The collar 28 mates with the under side of the lid 14 along the front and side edges provide a seal from moisture and odors. As used herein, "rear" refers to the side of the container 10 on which the hinge assembly is shown in FIG. 1. The terms "front" and "sides" are used in reference to the term "rear" as defined.

As illustrated in FIG. 2, proximate to the opening 30, the container body 12 includes a projecting lug or hinge knuckle 32 integrally molded into the sidewall 22. The lug 32 cantilevers from the container body 12, preferably in a direction generally parallel to a plane defined by the container opening 30 and generally perpendicular to the rear side 34 of the container body 12. The lug 32 has a length less than about 1 foot and preferably equal to approximately 4 to 5 inches. A base 36 of the lug 32, positioned proximate to the sidewall 22 of the container body 12, flares outwardly to provide greater structural support at the junction between the sidewall 22 and the lug 32. Preferably, the lug 32 is hollow inside, as illustrated in FIG. 3.

Figure 3:
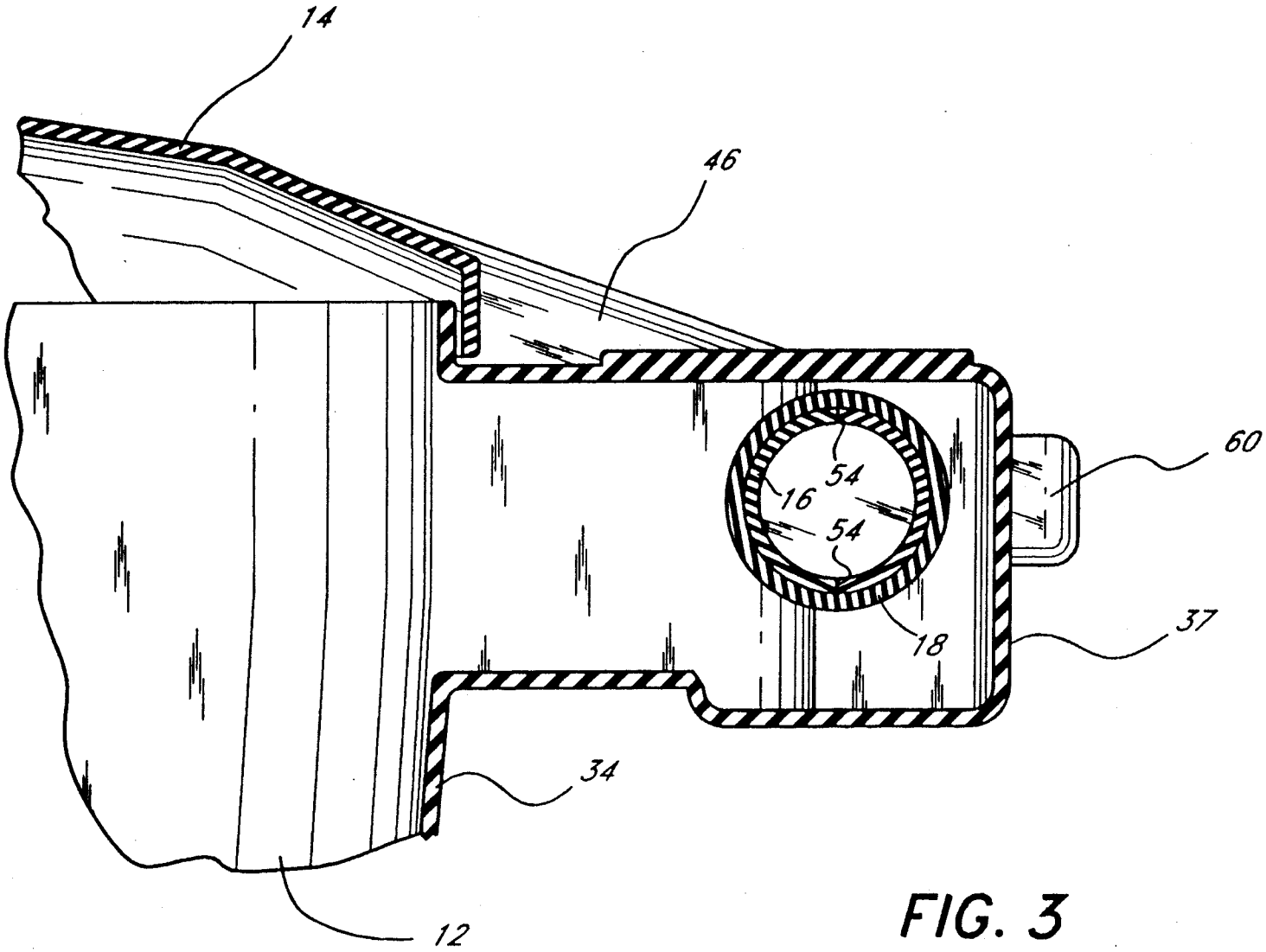
FIG. 3 is a cross-sectional view taken along line 3—3 of FIG. 1.
Figure 4:
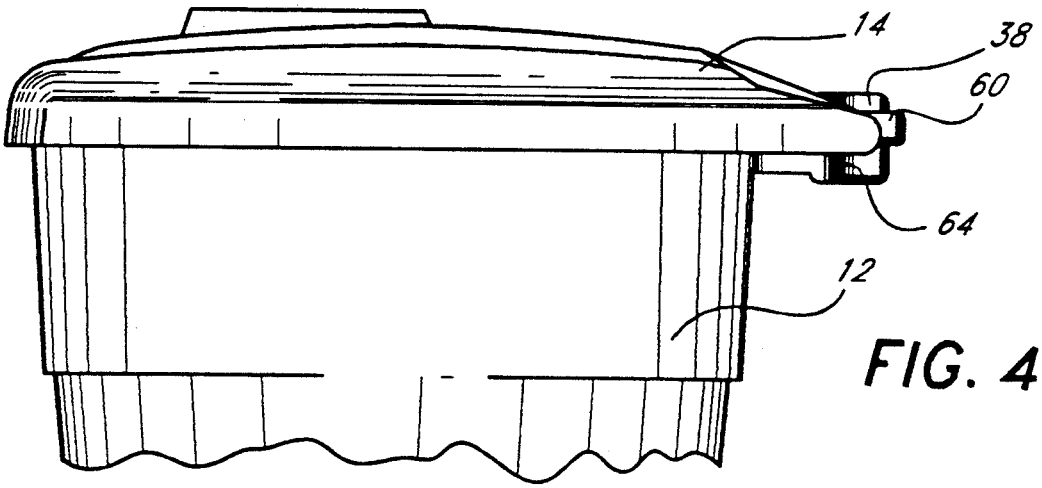
FIG. 4 is a partial side elevational view of the refuse container of FIG. 1 illustrating a lid in a closed position.

As shown in FIGS. 2 and 3, the lug 32 houses the axle bushing 18 which receives the axle 16 when assembled with the lid 14. Preferably, the axle bushing 18 is positioned near the end 37 of the lug 32 in a manner generally parallel to the container rear side 34 and transverse to a longitudinal axis of the lug 32, as best seen in FIG. 2. In particular, the axle bushing 18 is generally perpendicular to the longitudinal axis of the lug 32.

Preferably, the container body 12 additionally includes a second lug 38 positioned such that an axle bushing 40 of the second lug 38 co-linearly aligns with the axle bushing 18 of the first lug 32. Preferably, the lugs 32, 38 are symmetrically positioned on the container rear side 34 and are generally parallel to each other.

Referring to FIG. 2, the lid 14 comprises a generally flat, or more preferably, a slightly domed, cover portion 42 sufficiently sized to cover the container body opening 24. A vertical peripheral skirt 44 extends over the container body collar 28, with the lid 14 covering the container body 12, to shield the contents of the interior cavity 24 from the environment.

The lid 14 includes a pair of support arms 46 which extend from a rear edge 48 of the cover portion 42. The support arms 46 are each formed by four generally trapezoidal surfaces and have an external configuration generally tapering in cross-sectional area away from the cover portion 42, as seen in FIG. 2. Preferably, an end 50 of the support arm 46 is positioned below the plane of the cover portion 42 and smoothly blends into the skirt 44 at the junction with the cover portion 42. With the lid resting on top of the container collar 28, the ends 50 of the support arms 46 are adjacent to the axle bushings 18, 40 of the lugs 32, 38.

As shown in FIG. 2, the tubular axle or hinge pin 16 extends between the ends 50 of the support arms 46. The axle 16 has an outer diameter smaller than the cross-sectional interior diameter of the axle bushings 18, 40, and preferably has a diameter sized to slip-fit through the bushing 18, 40 to prevent binding without slop. The axle diameter is more preferably about 0.06 to 0.10 inch smaller than the diameter of the bushings 18, 40. In a most preferred embodiment, the axle diameter equals about $1\frac{3}{8}$ inch and the diameters of the bushings 18, 40 equal to about 1 7/16 inch. The axle 16 has a length sufficiently long to extend beyond an outer edge 52 of each lug 32, 38 when positioned through the bushings 18, 40. Preferably, however, the length of the axle is only slightly larger than the distance between the outer edges 52 of the lugs 32, 38 to enable free rotation of the lid with a limited degree of lateral slop. As a result, the hinge assembly is less likely to be pulled apart, as will be discussed below.

The lid 14 additionally includes a center support arm 56 positioned between the pair of support arms 46 to brace the mid-section of the axle 16. The center support arm 56 divides the axle 16 into two segments, each axle segment extending between the center support arm 56 and one of the pair of support arms 46.

The axle 16 has two division areas or cuts 54 each positioned between a support arm 46 and the center support arm 56, severing each axle segment into two portions to facilitate assembly. Preferably, the cuts are "bologna" cuts 54 oblique to a longitudinal axis of the axle 16. Advantageously, these cuts cant towards the center of the cover portion 42. Advantageously, these cuts cant towards the center of the cover portion 42 at a 45° angle. The bologna cut creates more longitudinal contact surface between the ends of the axle portions. As a result, forces transverse to the longitudinal axis of the axle, which compress the bologna cut, do not readily separate the axle portions. The oblique orientation of the bologna cut also aids in the assembly process, as will be discussed in detail below.

To manufacture the bologna cuts 54 into the axle 16, the mold portion for the axle includes an annular, washer-shaped structure (not shown) having a central aperture defined by a sharp edge which surrounds and projects into the area in the mold where the axle will be formed. In cross-section, the structure has a triangular shape forming the sharp edge. As a result, parts produced by the mold will have a weakened section or a cut along the portion of the axle 16 adjacent the sharp edge of the mold structure during manufacturing. If the axle 16 is not completely severed at the bologna cut 54 after molding, the bologna cuts 54 can be produced by slicing through the weakened structure at those locations. Alternatively, the necessary cuts in the axle could be made using a knife or any other appropriate cutting tool without the need to provide for weakening of the axle in the molding process.

The resulting structure between the support arms 46 and the axle 16 maintains the ends of the axle portions in a juxtaposed relationship. The flexible nature of the structure, aided by the flexibility of the material comprising the structure, allows flexure of the structure by applying a force to pull the ends of the axle portions apart to facilitate assembly. The elastic nature of the structure, however, biases the structure back to its original predeformed, juxtaposed position once the force deforming the structure ceases.

The distance between the cover rear edge 48 and the axle 16 of the lid is preferably sufficiently sized to permit an adult hand cover by a glove to be inserted between the cover rear edge 48 and the axle 16. The distance, however, should not be too large as the stability of the lid will be impaired. Preferably the distance between the rear edge 48 and the axle 16 ranges between one (1) to twelve (12) inches and more preferably equals about two (2) to four (4) inches.

Figure 5:
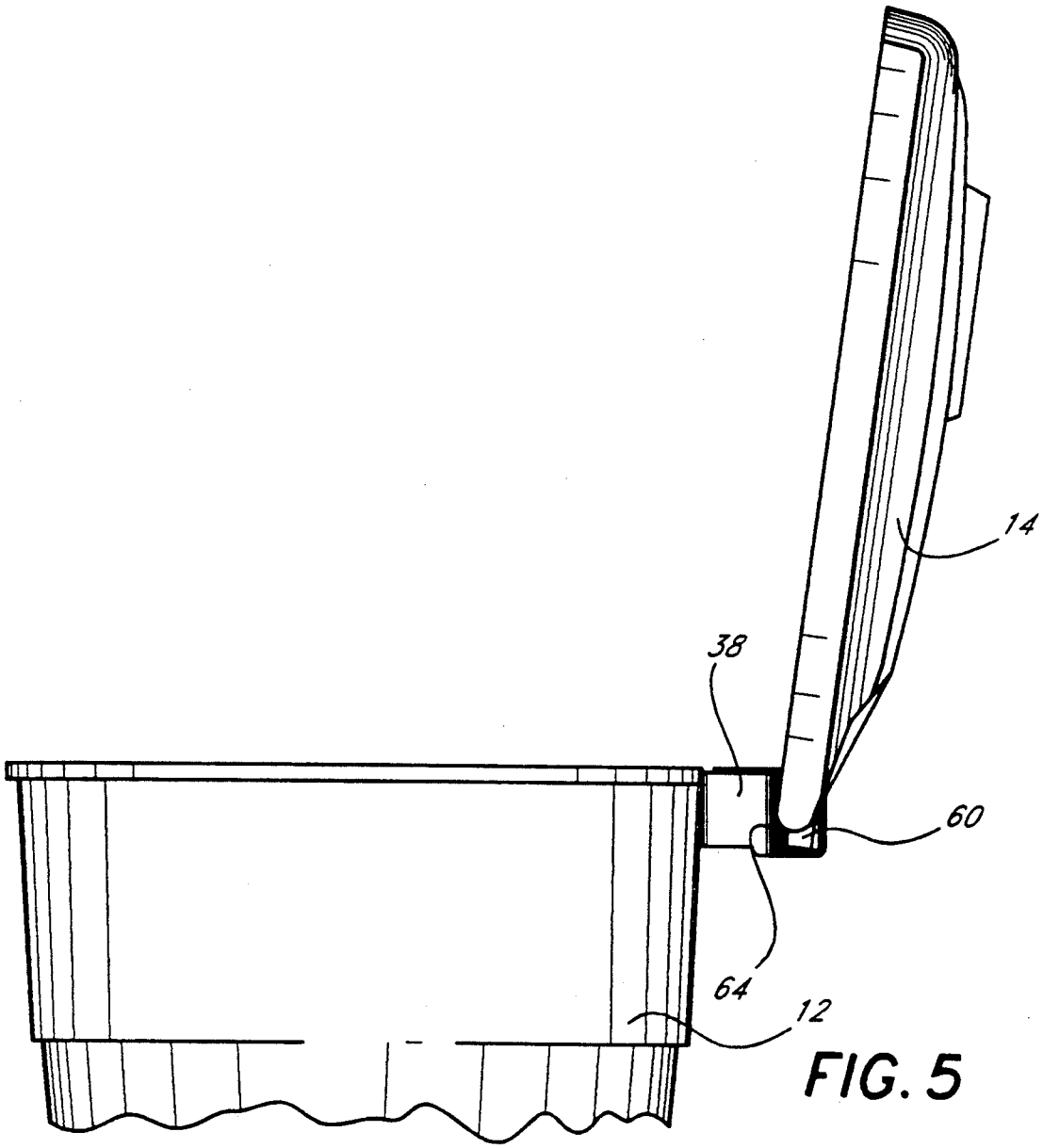
FIG. 5 is a partial side elevational view of the refuse container of FIG. 4 illustrating the lid in an open position.

As shown in FIGS. 1 through 5, the lid preferably includes a pair of lid stop 60, each lid stops 60 being positioned on the axle 16 proximate to the support arms 46 and extending distally from a distal surface 62 of the axle 16. The lid stop 28 is preferably of rectangular cross-section and extends for a sufficient distance to provide a firm stop. Preferably, this distance is greater than $\frac{1}{4}$ inch and more preferably is equal to $1\frac{1}{2}$ inches. It is also preferred that the container body lugs 32, 38 include abutment surfaces 64 positioned to engage the lid stops 60 when the lid 14 is raised from the container body opening 24 and positioned generally normally to the container body opening 24. Preferably, about a $\frac{3}{4}'' \times \frac{3}{4}''$ area of each lid stop 28 abuts against the corresponding abutment surface 64 with the lid in the raised position. FIG. 5 illustrates the lid 14 in the raised position.

FIGS. 1 and 2 additionally illustrate the refuse container 10 as having a pair of wheel wells 66 integrally molded into the container body 12. The wheel wells 66 are disposed on diametrically opposite sides of the container body rear side 34. The wheel wells 66 house a pair of wheels 68, with one wheel 68 being generally positioned within each wheel well 66. A wheel axle 70 extends through a pair of apertures 72 in the container body 12 to support the pair of wheels 68, which are rotatably coupled to the wheel axle 70 by fasteners 74, in a manner well known in the art. Preferably, the wheels 68 are sufficiently sized to solely support the refuse container 10 when tilted onto the wheels 68 to ease movement of the refuse container 10. In other words, the radius of the wheel 68 is preferably greater than a distance between the wheel axle 70 and the container bottom 20.

Preferably, the refuse container 10 additionally includes means to enable it to be used with conventional automated refuse collection trucks. Such means typically includes a metal bar (not shown) integrally molded into the refuse container 10 on a front side of the container body 12 which is grasped by an automated arm on the refuse collection truck. The lifting means may also be a mid-section shoulder 77 (see FIG. 1) alone or in combination with a metal bar to enable the container 10 to be grasped by lifting machinery, as known in the art.

Figure 6:
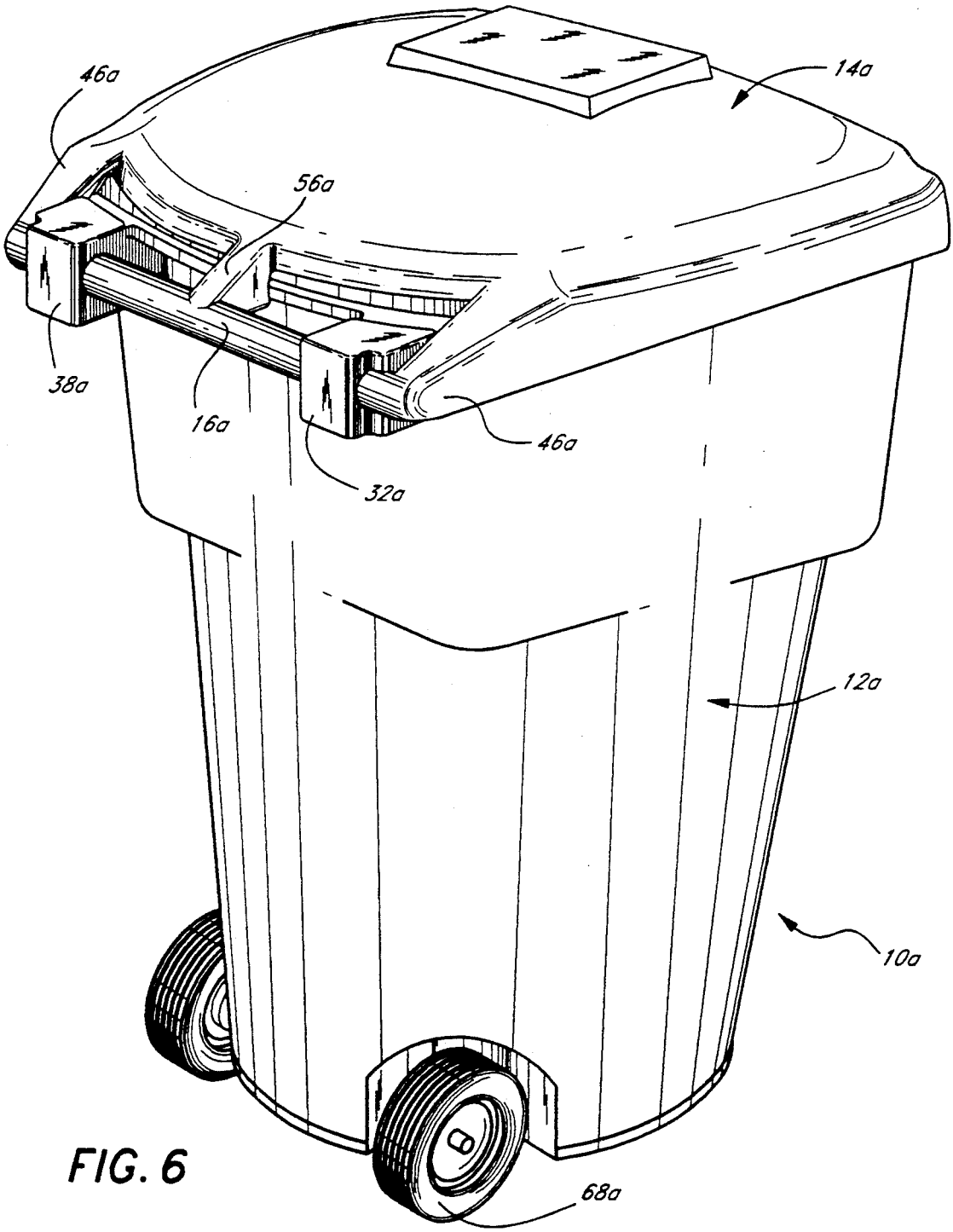
FIG. 6 is a perspective view of a refuse container in accordance with another embodiment of the present invention omitting a pair of lid stops which are illustrated in FIGS. 1 through 5.

FIG. 6 illustrates a refuse container 10*a* in accordance with another embodiment of the present invention.

Where appropriate, like numbers with an "a" suffix have been used to indicate like parts of the two embodiments. The refuse container 10*a* of FIG. 6 differs from the refuse container 10 of FIGS. 1 through 5 only by the omission of lid stops 60.

Figure 7:
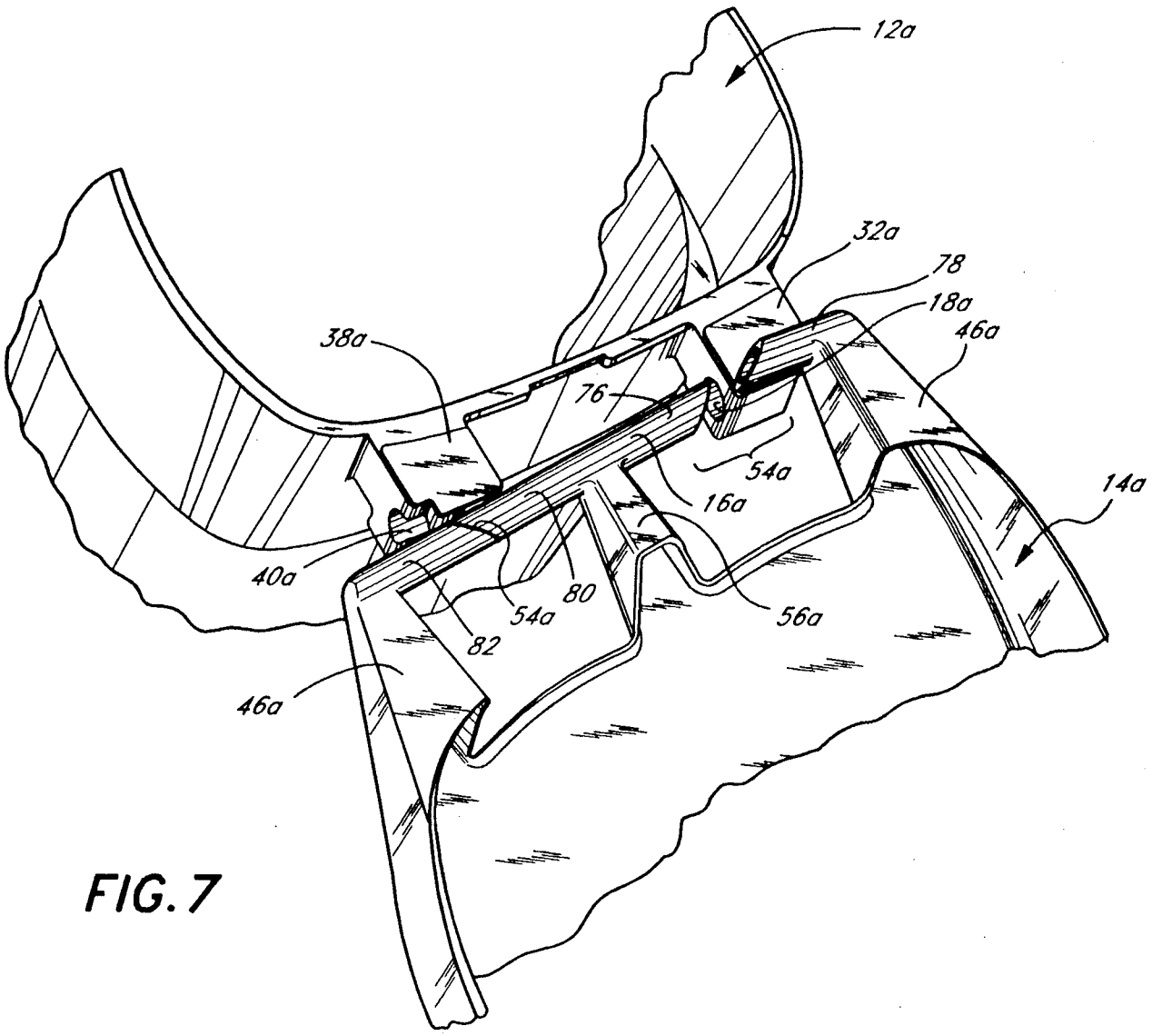
FIG. 7 is a partial elevated perspective view of the refuse container of FIG. 6 illustrating the separation of one bologna cut of a lid axle during an initial assembly step.
Figure 8:
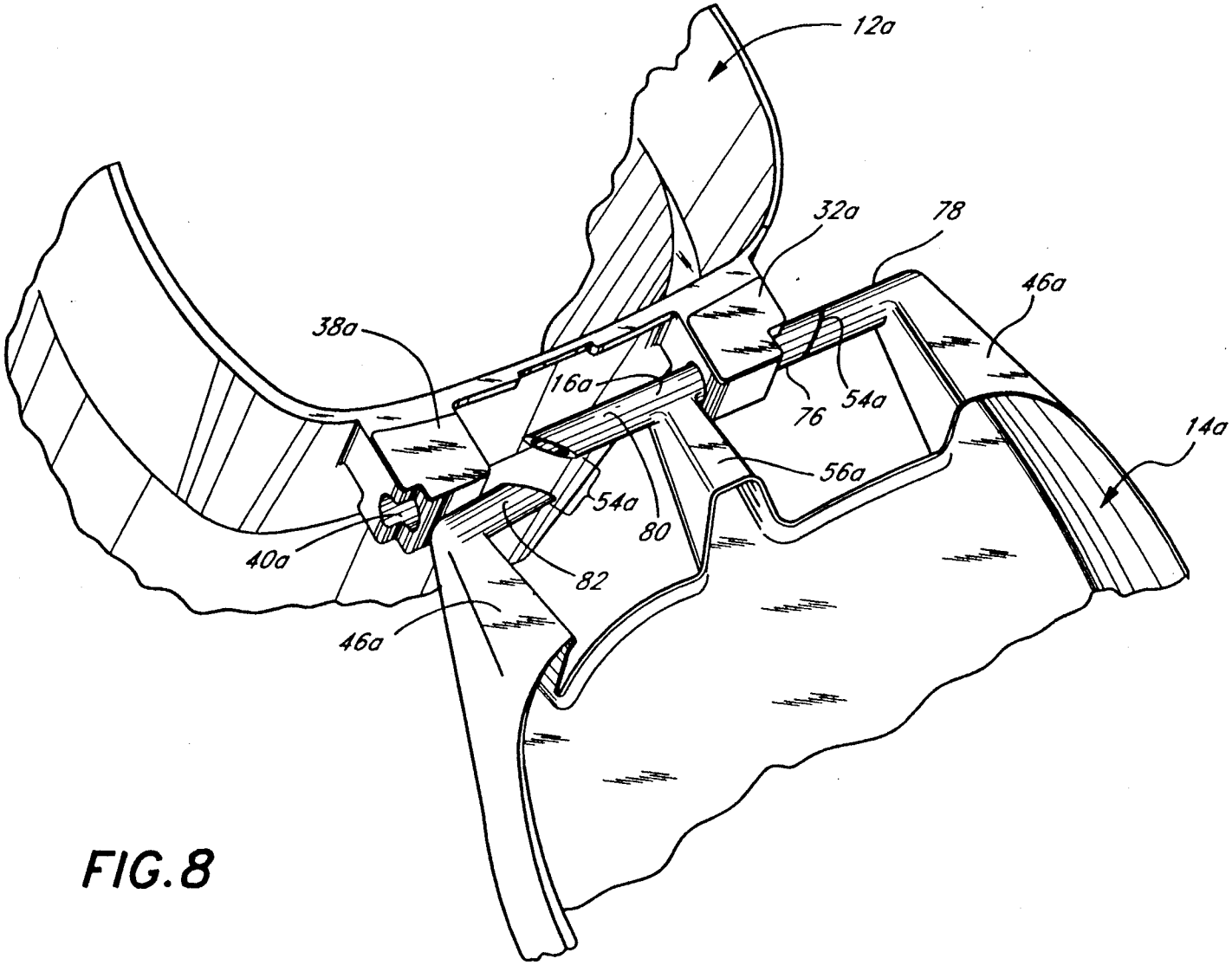
FIG. 8 is a partial elevated perspective view of the refuse container of FIG. 7 illustrating the insertion of an axle during the assembly process.
Figure 9:
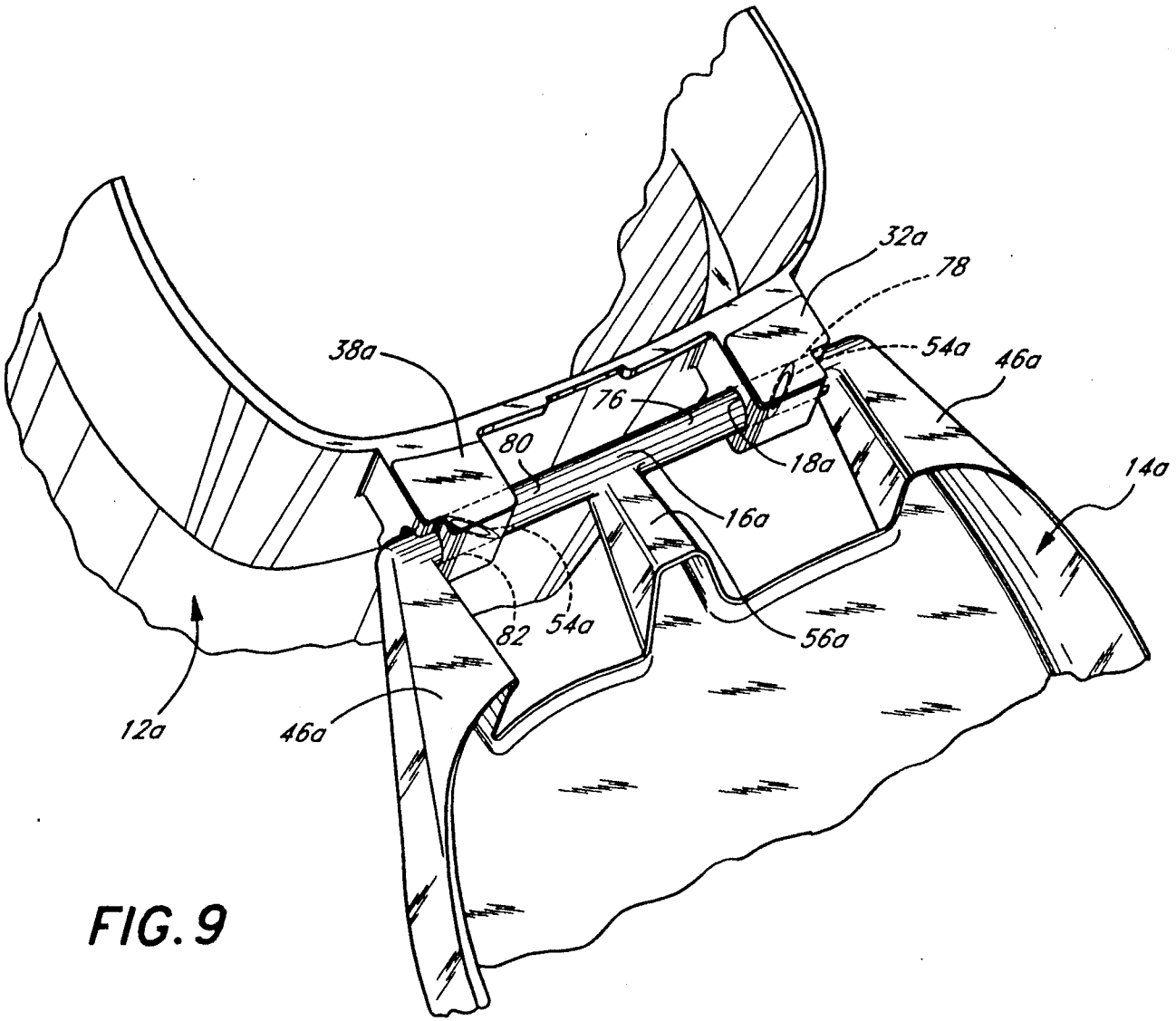
FIG. 9 is a partial elevated perspective view of a refuse container of FIG. 8 illustrating the lid axle coupled with a container body, with the bologna cuts positioned within support member bushings, as illustrated in phantom lines.

FIGS. 7 through 9 illustrate the assembly procedure of the refuse container 10*a*. It is contemplated that the assembly of the refuse container 10*a* shown in FIG. 6 and of the refuse container 10 shown in FIGS. 1 through 5 will be substantially similar, and the discussion herein of one will be understood as applying equally to both, unless specified to the contrary.

FIGS. 7 through 9 illustrate the assembly of the lid 14*a* with the container body 12*a* by positioning the lid 14*a* behind the container body 12*a*. When assembling the lid 14 to the container body 12 of the refuse container 10 of the first embodiment, the lid is positioned in an up-right position (i.e., normal to the container opening 30), and the axle 16 is inserted in the manner described below.

Referring to FIG. 7, the lid 14*a* assembles with the container body 12*a* by first pulling the portions of the axle 16*a* apart to a position enabling an inner axle portion 76 to be inserted into the axle bushing 18*a*. An outer axle portion 78 is preferably pulled above the container lug 32, as illustrated in FIG. 7. When assembling the refuse container 10 shown in FIG. 1, the outer axle portion is pulled beyond the end 50 of the container lug 32. As discussed above, the flexibility of the structure formed between the support arms 46*a* and the axle 16*a* and the material comprising the structure permits elastic deformation of these components during assembly.

The inner axle portion 76 is then slid through the bushing 18*a* to position the first bologna cut 54*a* beyond the support member outer edge 52*a*. In this position, the outer axle portion 78 springs back to a position juxtaposing the two axle portions 76, 78 at the bologna cut 54*a*, as shown in FIG. 8.

The assembly continues by pulling the axle 16 apart at the second bologna cut 54*a* to enable a second inner axle portion 80 to insert into the second bushing 40*a*. An outer portion 82 is pulled beyond the end 50 of the container lug 38. The lid 14 and axle 16 are slid towards the second lug 38 to insert the second inner axle portion 80 into the second bushing 40*a* as far as possible. The support arm 46*a* is subsequently pulled outwardly and forced towards the container body 12*a* to insert the second outer axle portion 82 into the axle bushing 40*a* from the outer side. Advantageously, the bologna cuts 54*a* cant toward the center of the cover portion 42*a* to ease the insertion of the second outer axle portion 82. The incline surface of the bologna cut 54*a* assist in forcing the support arm 46*a* outwardly when forcing the axle 16*a* towards the container body 12*a*.

When assembling the refuse container 10 of FIG. 1, the second outer portion axle portion is inserted into the bushing 40 by pulling a portion of the container body 12 between the lugs 32, 38 inward towards the center of the opening 30, and pushing the center support arm 56 towards the lug 38. As a result, the rear wall 34 of the container body 12 tends to collapse and draws the lugs 32, 38 closer together to provide the clearance needed to insert second outer axle portion.

As the center arm 56 is forced towards the container lug 38, the incline surface of the second axle portion end contacts the outer edge 52 of the lug 38. Continued force in the direction of the lug 38 causes the incline surface to slide along the outer edge 52 and thereby deforms the support arm 46 outwardly. With the outer axle portion positioned beyond the outer edge 52, the outer axle portion is inserted into the bushing 40. The outer axle portion springs into the bushing to a position juxtaposed to the second inner axle portion.

FIG. 9 partially illustrates the final assembly of the refuse container 10*a* with the second axle portions 80, 82 juxtaposed and both bologna cuts 54*a* positioned within the bushings 18*a*, 40*a* to prevent the axle 16 from being readily pulled apart, even when handled by refuse collectors and automated lifting equipment. In addition, the bologna cuts are unseen in assembly, thereby improving the aesthetic appeal of the hinge assembly.

In assembly, as best seen in FIG. 6, a portion of the axle 16*a* is exposed between the support arms 46*a*, 56*a* to enable one to grasp the axle 16*a* as a handle to tilt and maneuver the portable refuse container 10*a*. In addition, because the axle 16*a* is integrally formed with the lid 14*a*, one holding onto the axle 16*a* can sense lid movement.

Figure 10:
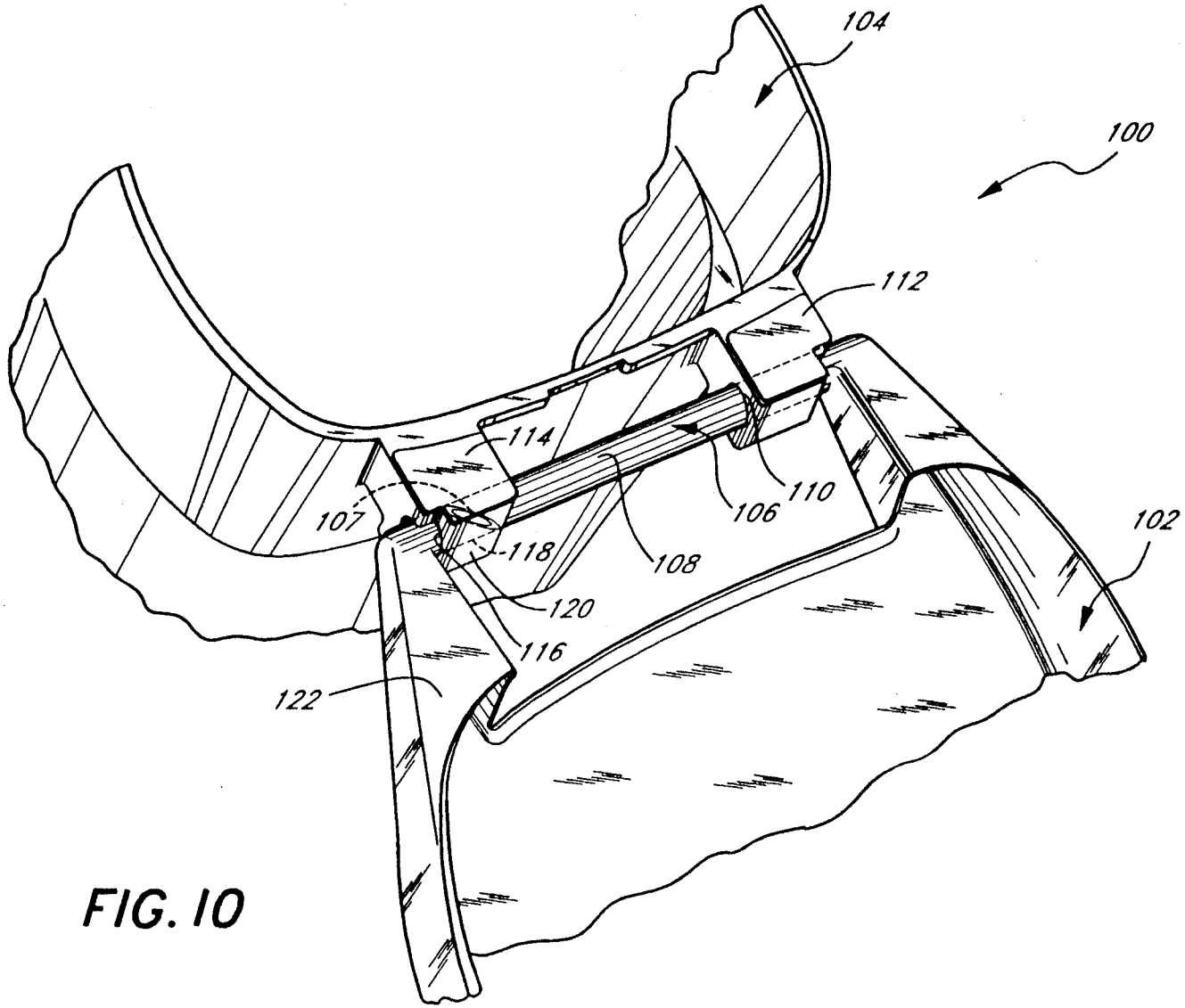
FIG. 10 is a partial elevated perspective view of a refuse container in accordance with another embodiment of the present invention having two support arms suspending an axle having one bologna cut.

FIG. 10 illustrates a refuse container 100 in accordance with the present invention. The refuse container 100 is similar to the previously described embodiments, except that it includes only one bologna cut and omits the center support arm.

The lid 102 assemblies to the container body 104 by pulling the portions of an axle 106 apart at a bologna cut 107 to enable an inner axle portion 108 to be inserted into an axle bushing 110 of a container lug 112. The inner axle portion 108 is inserted into the bushing 110, and slid towards a second container lug 114. The portions of the axle 106 are again pulled apart to enable an end of the inner axle portion 108 to be inserted into a second bushing 116 housed in the second lug 114. An outer portion 118 is pulled beyond the end 120 of the container lug 114. The support arm 122 is subsequently pulled outwardly and forced towards the container body 104 to insert the outer axle portion 118 into the axle bushing 116 from the outer side. The incline surface of the bologna cut 107 assists in forcing the support arm 122 outwardly when forcing the axle 106 towards the container 104. In assembly, the bologna cut preferably lies within the bushing 116 for the aforementioned reasons.

Although this invention has been described in terms of certain preferred embodiments, other embodiments that are apparent to those of ordinary skill in the art are also within the scope of this invention. Accordingly, the scope of the invention is intended to be defined only by the claims which follow.

What is claimed is:

1. A refuse container, comprising:

a container body having a bottom, an upstanding sidewall extending from the circumference of said bottom to define an interior cavity, said sidewall terminating in an upper edge to define an opening into said interior cavity;

a first lug extending from said sidewall from said interior cavity, said lug having an axle bushing; and an integrally molded lid comprising a cover portion to overlie said opening and an axle extending between a pair of support arms, said axle being sized to be insertable into said axle bushing and being separated in two axle portions by a cut to allow said axle to separate between said support arms and to be inserted through said axle bushing to rotatably couple said lid and said container body together.

2. The refuse container of claim 1, wherein a portion of said axle between said support arms is exposed to function as a handle.

3. The refuse container of claim 1, wherein said lid additionally comprises a third support arm positioned between said pair of support arms to generally support a mid-section of said axle.

4. The refuse container of claim 3, wherein said lid additionally comprises a second cut positioned along said axle on a side of said third support arm opposite from said first cut, and said container additionally comprises a second lug extending from said sidewall in a direction generally parallel to said first lug and having an axle bushing adapted to receive a portion of said axle.

5. The refuse container of claim 1, wherein said support arms are formed of a resilient, flexible material.

6. The refuse container of claim 1, where said cut is a bologna cut obliquely positioned to the longitudinal axis of said axle.

7. The refuse container of claim 6, wherein said bologna cut cants towards the center of the cover portion.

8. The refuse container of claim 7, wherein said bologna cut cants towards the center of the cover portion at a 45° angle.

9. The refuse container of claim 1, wherein said bottom, sidewall and lug comprise an integrally molded structure, and said cover, support arms and axle comprise an integrally molded structure.

10. The refuse container of claim 9, wherein said container body and lid are rotationally molded of a crosslinked polyethylene.

11. The refuse container of claim 1, wherein said lug has an abutment surface and said axle has a stop positioned to abut said abutment surface with said lid raised from said container body opening.

12. An apparatus, comprising:

a body member having a generally cylindrical shaped opening; and an integrally molded top member adapted to cover at least a portion of said body member, said top member comprising an axle spanning between a pair of support arms with a cut severing said axle to allow said axle to separate and to be inserted into said opening, said axle being sized to fit into said opening to rotatably couple said top member with said body member.

13. The apparatus of claim 12, wherein said axle slip fits into said opening.

14. The apparatus of claim 12, wherein said cut lies within said opening with said top member coupled with said body member.

15. The apparatus of claim 12, wherein said body member additionally comprises a second cylindrical shaped opening.

16. The apparatus of claim 15, wherein said second opening is spaced from said first opening by a distance less than the length of said axle.

17. The apparatus of claim 16, wherein said top member additionally comprises a center support arm positioned between said pair of support arms at approximately the center of said axle, said axle additionally comprising a second cut positioned along said axle on a side of said center support arm opposite from said first cut.

18. The apparatus of claim 17, wherein said first cut and said second cut lie within said first opening and said second opening, respectively, with said top member coupled with said body member.

19. The apparatus of claim 12, wherein said cut is a bologna cut oblique to the longitudinal axis of the axle, canting towards the center of the top member.

20. The apparatus of claim 12, wherein a portion of said axle between said support arms is exposed to function as a handle.

21. A refuse container, comprising:

a container body having an integrally molded structure comprising a bottom, an upstanding sidewall extending from the circumference of said bottom to define an interior cavity, said sidewall terminating in an upper edge to define an opening into said interior cavity, and a pair of lugs cantilevered from said sidewall away from said interior cavity, each lug having an axle bushing positioned generally transverse to a longitudinal axis of said lug, said lugs being positioned generally parallel each other to generally align said axle bushings of said support members; and a lid having an integrally molded structure comprising a cover portion to overlie said interior cavity opening, three support arms extending from said cover portion and a pair of axles, each axle extending between two of said support arms, said axles being sized to insert into said axle bushings and each axle having a bologna cut generally bifurcating said axle to allow said axle to separate between two of said support arms to insert through said axle bushing to rotatably couple said lid and said container together, each bologna cut being positioned to cant towards the center of the cover portion at a 45° angle.

22. The refuse container of claim 21, wherein said container body and lid are rotationally molded of a cross-linked polyethylene.

* * * * *

UNITED STATES PATENT AND TRADEMARK OFFICE

CERTIFICATE OF CORRECTION

PATENT NO. : 5,217,136

DATED : June 8, 1993

INVENTOR(S) : Gordon J. Sanden, Jr.

It is certified that error appears in the above-indentified patent and that said Letters Patent is hereby corrected as shown below:

Column 8, line 58, change "sidewall from" to --sidewall away from --.

Signed and Sealed this

Fifteenth Day of March, 1994

*Attest:*

*Attesting Officer*

BRUCE LEHMAN

*Commissioner of Patents and Trademarks*